United States Patent [19]

Zafred

[11] Patent Number: 4,580,426

[45] Date of Patent: Apr. 8, 1986

[54] HYBRID EXPANSION APPARATUS AND PROCESS

[75] Inventor: Paolo R. Zafred, Pittsburgh, Pa.

[73] Assignee: Westinghouse Electric Corp., Pittsburgh, Pa.

[21] Appl. No.: 584,225

[22] Filed: Feb. 27, 1984

[51] Int. Cl.[4] ..... B21D 39/08; B23P 11/02

[52] U.S. Cl. ..... 72/58; 29/421 R; 29/523; 29/727; 72/61

[58] Field of Search ..... 29/157.4, 421 R, 523, 29/727; 72/58, 60, 61, 62, 57, 122, 125, 370

[56] References Cited

U.S. PATENT DOCUMENTS

| | | | |
|---|---|---|---|
| 942,184 | 12/1909 | Persons | 29/523 X |
| 1,737,539 | 11/1929 | Petry | 72/58 |
| 2,238,212 | 4/1941 | Cornell | 72/58 |
| 2,954,064 | 9/1960 | De Mers | 29/523 |
| 3,585,701 | 6/1971 | Stary | 29/727 X |
| 3,906,771 | 9/1975 | Martin | 72/122 |
| 3,924,433 | 12/1975 | Martin | 72/122 |
| 4,007,699 | 5/1977 | Clemens | 72/377 X |
| 4,134,286 | 1/1979 | Martin | 72/122 |
| 4,210,991 | 7/1980 | Cooper | 72/58 X |
| 4,453,304 | 6/1984 | Astill et al. | 29/421 R |

FOREIGN PATENT DOCUMENTS

| | | | |
|---|---|---|---|
| 651169 | 3/1979 | U.S.S.R. | 29/523 |

*Primary Examiner*—E. Michael Combs
*Attorney, Agent, or Firm*—L. A. De Paul

[57] ABSTRACT

An improved sleeving apparatus and process capable of simultaneously expanding and rolling an interference joint between a reinforcing sleeve and a heat exchanger tube is disclosed herein. The apparatus generally comprises an elongated housing onto which upper and lower rollers are mounted, and upper and lower hydraulic expanders capable of applying a radially expansive force onto a sleeve across the length of the rollers. The rolls in the rollers are driven by a common drive shaft which is coupled to a hydraulic motor. The apparatus includes a torque controller including a torque sensor and a computer for controlling the torque, and hence the rolling pressure, that the rollers place on the inside surface of the sleeve. The torque sensor is mechanically connected to the output of the driving means of the drive shaft, and electrically connected to the microcomputer. The microcomputer is connected to the control valve of the power supply of the hydraulic motor driving the drive shaft. The torque value programmed into the microcomputer of the torque controller may be chosen so that the rolling pressure exerted by the rolls elongates the metal in the sleeve at the interference joint to the same extent to which this metal is contracted by the hydraulic expanders, thereby resulting in a substantially stress-free joint.

37 Claims, 14 Drawing Figures

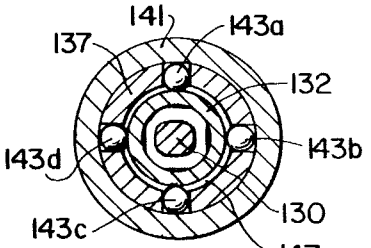
FIG. 4F
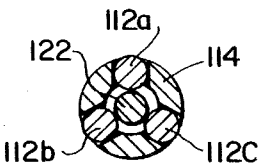
FIG. 4E
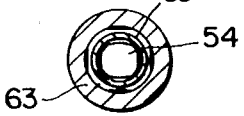
FIG. 4D
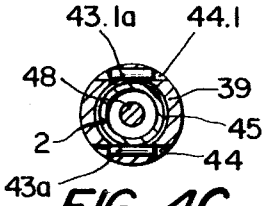
FIG. 4C
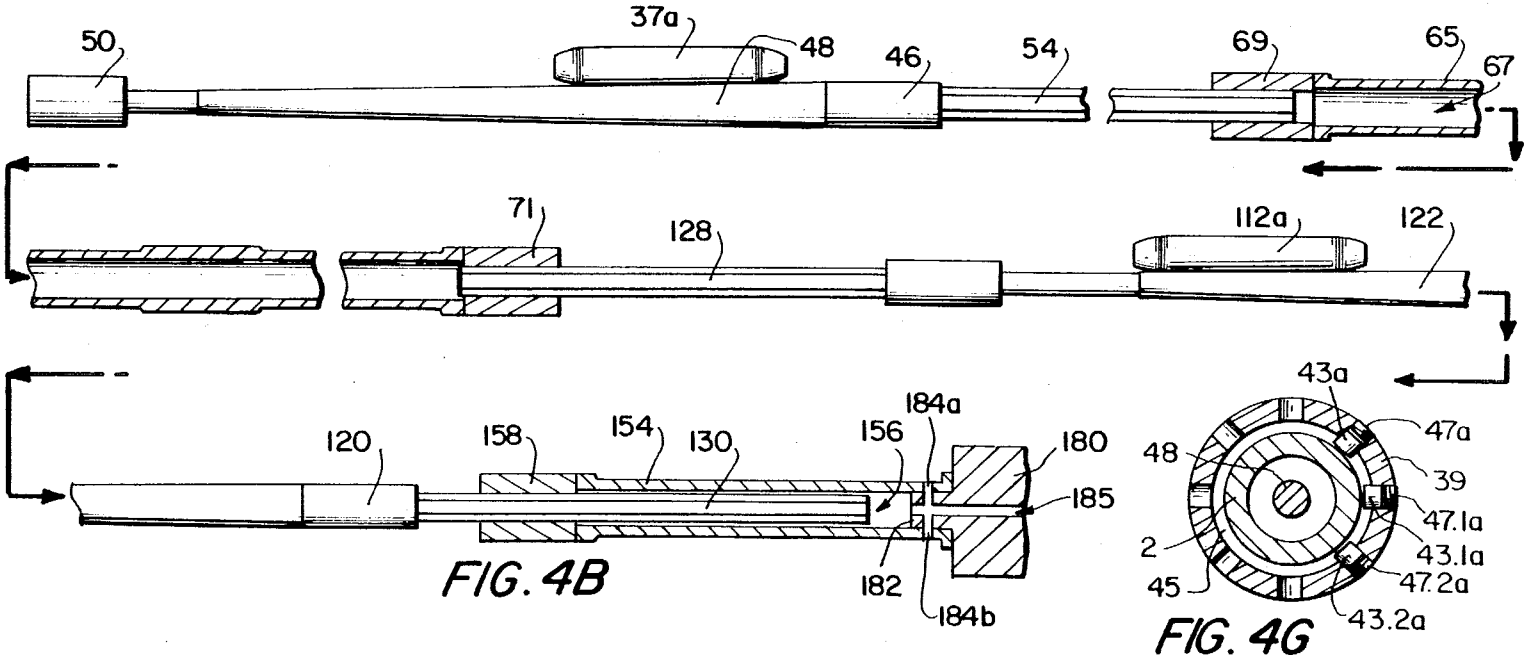
FIG. 4G
FIG. 4B

HYBRID EXPANSION APPARATUS AND PROCESS

FIELD OF THE INVENTION

This invention is both an apparatus and a process for simultaneously hydraulically and mechanically expanding a tube. It is particularly useful in creating interference-type joints between reinforcing sleeves and heat exchanger tubes.

BACKGROUND OF THE INVENTION

Hydraulic expansion devices for expanding tubes are known in the prior art. In particular, such devices are used to effect an interference-type joint between a reinforcing sleeve and the tube of a heat exchanger, such as a nuclear steam generator. In such steam generators, sludge consisting of boron salts and other corrosive chemicals frequently accumulates in the annular spaces between the heat exchanger tubes and the tube sheet which surrounds them. Over a period of time, these corrosive chemicals, in combination with the hot water which flows around such tubes, can cause corrosion degradation in the outside walls of the tubes in the regions near the tube sheet. If unchecked, such corrosion can ultimately result in fissures in the walls of the tubes, which can cause water leakage through the walls of the tubes. In addition to reducing the efficiency of the steam generator as a whole, such leakage can cause radioactive water from the primary water system to contaminate the non-radioactive water in the secondary water system in the steam generator.

In order to repair these tubes in the tube sheet regions where such corrosion degradation occurs, vaious techniques have been developed for joining reinforcing sleeves on the inner walls of these tubes across the corrosion-degraded portions. This process is called "sleeving". In the prior art, such sleeving was accomplished by means of a three-step process which utilized three distinct tools. In the first step of the process, after the reinforcement sleeve was concentrically disposed within the tube across its corrosion-degraded portion, the ends of the sleeve were hydraulically expanded by the mandrel of a hydraulic expansion unit until they forcefully engaged and plastically deformed the inner walls of the tube. Second, the hydraulically expanded regions were mechanically rolled with a rolling tool in order to strengthen and deepen the interference-type joint between the sleeve and the tube which the hydraulic expansion began. Third, the resulting strengthened joints were brazed with a special electrical-resistance brazing tool to render these joints leakproof.

While such sleeving processes and devices are capable of creating satisfactory interference-type joints between the ends of a reinforcing sleeve and a section of corrosion-degraded tubing, the use of such processes and specialized tools is time-consuming and expensive. In some cases, the three-step procedure makes it difficult, if not impossible, for a maintenance team to perform all of the sleeving repairs necessary in a particular steam generator during the normally-scheduled maintenance "down" times of a nuclear power plant, in which the entire plant is overhauled. This limitation sometimes necessitates setting aside special "down" times for the sleeving operation alone, which can effectively add millions of dollars to the cost of running the nuclear plant. The relative slowness with which such sleeving repairs are made results in high labor costs and the additional negative consequence of exposing the workers on such maintenance teams to a considerable amount of radioactivity. Even though the workers wear protective clothing, the exposure to such radioactivity over such long lengths of time increases the probability of the occurrence of a radiation-related injury. Finally, the use of a separate hydraulic expansion unit, followed by the separate use of a mechanical roller, sometimes makes it difficult to generate a substantially stress-free joint wherein the longitudinal contraction of the sleeve caused by the hydraulic expansion is exactly cancelled out by the elongation of the tube caused by the rolling operation.

Clearly, a need exists for a sleeving apparatus and process which is faster and which obviates the need for exposing maintenance personnel to an inordinate amount of radioactivity. Ideally, such a process and device would also be capable of consistenly providing stress-free joints.

SUMMARY OF THE INVENTION

In its broadest sense, the invention is an apparatus and process for hydraulically and mechanically expanding a conduit against a surrounding structure in order to produce a joint therebetween. Both the apparatus and process of the invention are particularly adapted for quickly and effectively sleeving a tube in a heat exchanger by creating a substantially stress-free interference-type joint between the sleeve and the tube.

The apparatus of the invention generally comprises a hydraulic expander for applying a radially expansive force of the inside of a longitudinal portion of the sleeve, and a roller assembly for simultaneously rolling at least a part of this longitudinal portion of the sleeve. Hydraulic expansion tends to contact the sleeve along its longitudinal axis. However, mechanical rolling of the sleeve tends to elongate the sleeve along this axis. In the invention, the roller assembly preferably exerts sufficient rolling pressure on the hydraulically expanded portion of the sleeve to substantially offset any longitudinal contraction occurring in the expanded portion of the sleeve, thereby creating a substantially stress-free joint.

The invention may include an upper and lower roller assembly, each of which has at least three extendable rolls. Each roll assembly may include a tapered mandrel for extending and driving the rolls in the upper and lower roller cages. The tapered drive mandrels may be slidably coupled together by a drive shaft which in turn is mechanically engaged to a drive means, such as a hydraulically operated motor. The tapered drive mandrels may further include hydraulic pistons which are fluidly connected to the same source of pressurized hydraulic fluid which operates the hydraulic expander, so that each of the drive mandrels extends its respective rolls whenever the hydraulic expander applies a radially expansive force onto the inside of the sleeve. Additionally, the invention may include a torque sensor mechanically connected to the output shaft of the hydraulic motor, as well as a torque controller electrically connected to the torque sensor and the hydraulic motor for controlling the amount of torque that the drive shaft applies to the upper and lower rolls. In the preferred embodiment, the torque controller includes a microcomputer. Preselected torque values may be entered into the control means so that the torque, and hence the rolling pressure applied by the rolls, serves to offset the longitudinal contraction experienced by the sleeve in the joint area as a result of the hydraulic expansion. In order that the roller assemblies may selectively apply different torques onto their respective joints, the top roller cage may include right-hand slots, and the bottom roller cage may include left-hand slots, so that only the top rolls engage the sleeve when the shaft is driven in a clockwise direction, and only the bottom rolls engage the sleeve when the shaft is driven in a counterclockwise direction. This arrangement also minimizes the torque load applied to the drive shaft during the rolling operation.

The hydraulic expander of the invention may comprise a source of pressurized hydraulic fluid connected to a bore in the center of the tool housing, and a pair of opposing fluid seals on either side of each of the roller cages for creating a fluid-tight seal across the longitudinal portions of the sleeve being expanded. In the preferred embodiment, these seals include a pair of opposing O-rings which circumscribe annular ramps located above and below each of the roller cages. The pressurized hydraulic fluid pushes the O-rings up their respective ramps, thereby tightly wedging them between the tool housing and the inner walls of the sleeve, and creating a fluid-tight seal.

In the process of the invention, the longitudinal portion of the sleeve subjected to the radially expansive force of the hydraulic expander is simultaneously mechanically rolled by the rolling means. The torque detector constantly monitors the amount of torque applied to the upper and lower rollers by the drive shaft, and the torque controller disengages the rollers at preselected peak torques. The amount of torque selected and entered into the control means preferably causes the rolls to apply enough rolling pressure on the inside portions of the sleeve to offset any longitudinal contraction caused in the joint areas by the hydraulic expanders.

BRIEF DESCRIPTION OF THE SEVERAL FIGURES

FIG 4B is a side, cross-sectional view of the drive shaft and mandrels which drive the upper and lower rollers of the sleeving tool used in the apparatus of the invention;

FIGS. 4C, 4D, 4E and 4F are each bottom, cross-sectional views of the sleeving tool used in the apparatus of the invention, cut along the lines C—C, D—D, E—E and F—F in FIG. 4A;

FIG. 4G is an alternate embodiment of the roller cage retaining means shown in FIG. 4C;

DETAILED DESCRIPTION OF THE PREFERRED EMBODIMENT

General Overview of the Structure and Operation

Figure 1:
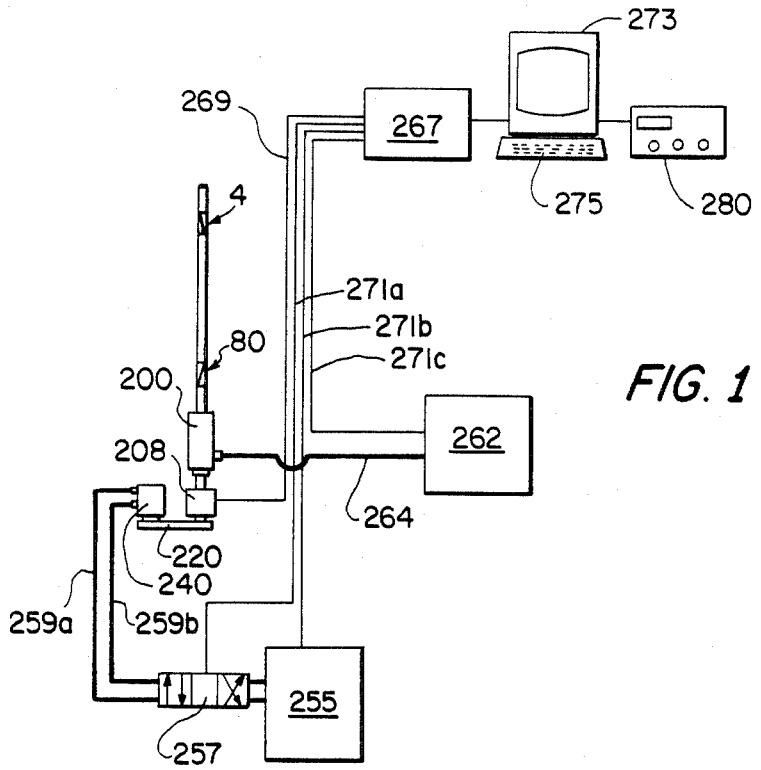
FIG. 1 is a generalized, schematic view of the expansion apparatus of the invention.
Figure 2A:
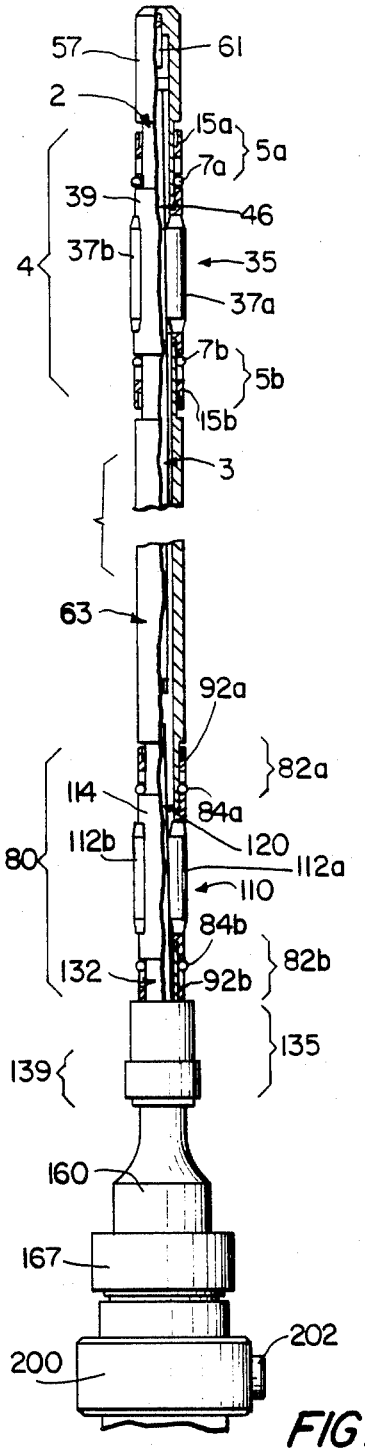
FIG. 2A is a generalized, partial cross-sectional view of the sleeving tool used in the apparatus of the invention.
Figure 2B:
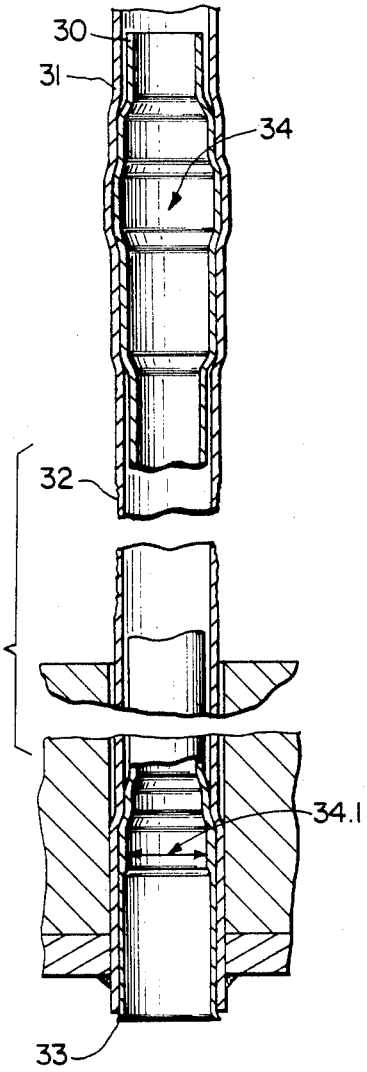
FIG. 2B is a cross-sectional view of the interference-type joint produced by the expansion apparatus of the invention.

With reference now to FIGS. 1, 2A and 2B, wherein like numerals represent like parts of the invention, the improved expansion apparatus 1 generally comprises a sleeving tool 1.1 having upper and lower roller and expander assemblies 4 and 80, respectively, in its elongated cylindrical housing. The upper roller and expander assembly 4 includes an upper roller 35 having three elongated rolls 37*a*, 37*b* and 37*c* which are rotatably mounted within a right-handed roller cage 39. Likewise, the lower roller and expander assembly 80 includes a lower roller 110 having three rolls 112*a*, 112*b* and 112*c* rotatably mounted within a left-handed roller cage 114. Throughout the center of the elongated, cylindrical housing of the sleeving tool 1.1 is an axially disposed bore 3, through which extends a drive shaft assembly including upper and lower tapered drive mandrels 46 and 120 which are slidably mounted at either end of a central drive shaft 65. These tapered drive mandrels 46 and 120 are longitudinally extendable and retractable along the bore 3 by means of pressurized hydraulic fluid introduced into bore 3 through a high pressure swivel joint 200. To persons skilled in the machine tool arts, mandrels 46 and 120 are known as "floating" mandrels due to their ability to be hydraulically slid along the length of the tool 1.1. Additionally, the upper and lower mandrels 46 and 120 may be rotatively driven by hyraulic motor 240 through transmission assembly 220 and torque sensor 208. Because of the engagement between the tapered bodies 48 and 122 and the rolls in the upper and lower rollers 35 and 110, the tapered mandrels 46 and 120 are capable of extending and driving the rolls 37*a*, 37*b*, 37*c* and 112*a*, 112*b*, 112*c* (as is best shown in FIG. 4B).

Both the upper and lower roller and expander assemblies 4 and 80 also include a pair of O-ring assemblies 5*a*, 5*b* and 82*a*, 82*b* on either side of the roller cages 39 and 114, respectively. The O-ring assemblies 5*a* and 5*b* of the upper roller and expander assembly 4 each include an O-ring 7*a*, 7*b* which circumscribes an annular ramp in the tool housing, as well as a spring loaded retaining ring assembly 15*a*, 15*b*. The O-ring assemblies 82*a*, 82*b* of the lower roller and expander assembly 80 include identical structures in O-rings 84*a*, 84*b* and spring loaded retaining ring assemblies 92*a*, 92*b*. The O-ring assemblies 5*a*, 5*b* and 82*a*, 82*b* create a fluid-tight seal across their respective rollers 35 and 110 when pressurized hydraulic fluid is admitted through the centrally disposed bore 3 of the housing of the tool 1.1 from the hydraulic expansion unit 262, which is fluidly connected to the bore 3 through high pressure hose 264 and high pressure swivel joint 200. More specifically, the O-rings 7*a*, 7*b* and 84*a*, 84*b* in each of the O-ring assemblies 5*a*, 5*b* and 82*a*, 82*b* roll up their respective annular ramps and wedge themselves between the outside surface of the housing of the tool 1.1 and the inside surface of the sleeve positioned over the tool 1.1 whenever pressurized hydraulic fluid is admitted into the centrally disposed bore 3 in the housing of the tool 1.1.

Because the pressurized hydraulic fluid flowing from the hydraulic expansion unit 262 through the bore 3 of the housing of the tool 1.1 extends the upper and lower drive mandrels 46 and 120 into engagement with the rolls 37*a*, 37*b*, 37*c* and 112*a*, 112*b*, 112*c* while simultaneously applying a hydraulic expansion force on the sleeve between the O-ring assemblies 5*a*, 5*b* and 82*a*, 82*b*, the sleeving tool 1.1 is capable (when the mandrels 46 and 120 are rotated by hydraulic motor 240) of simultaneously hydraulically expanding and mechanically rolling the upper and lower ends of a reinforcing sleeve 30 against the inside walls of a heat exchanger tube 31.

Generally speaking, the remaining components of the sleeving apparatus 1 of the invention serve to control and coordinate the relative amounts of hydraulic expanding pressure and mechanical rolling pressure exerted on the sleeve 30 by the upper roller and expander assemblies 4 and 80 of the sleeving tool 1.1. These components include a hydraulic power supply 255 which is connected to the hydraulic motor 240 via a pair of hydraulig hoses 259*a*, 259*b*, and a directional control valve 257 which is capable of reversing the direction of the flow of hydraulic fluid through motor 240. The primary control component of the apparatus 1 is the microcomputer 267. The input of the microcomputer 267 is electrically connected to the output of the torque sensor 208 via cable 269; the output of this microcomputer is electrically connected to the directional control valve 257, the hydraulic power supply 255, and the hydraulic expansion unit 262 via electrical cables 271*a*, 271*b* and 271*c*, respectively. The microcomputer 267 is further connected to a television monitor 273 and a conventional keyboard 275, as well as a torque analyzer 280, as indicated. The microcomputer 267 is programmed to execute the steps 306–324 in the flow chart illustrated in FIG. 6.

In operation, a reinforcing sleeve 30 is slid over the cylindrical housing of the sleeving tool 1.1. The tool 1.1 and its sleeve are then inserted into the open end of the tube being sleeved. An appropriate peak pressure is chosen for the hydraulic expansion unit 262, along with appropriate peak torque values for the rollers 35 and 110. These values are entered into the memory of the microcomputer 267. The microcomputer 267 then simultaneously actuates both the hydraulic power supply 255 and the hydraulic expansion unit 262. The hydraulic expansion unit 262 generates a stream of high pressure hydraulic fluid (which is deionized water in the preferred embodiment) which flows through high pressure hose 264, swivel joint 200, and up through the centrally disposed bore 3 in the tool 1.1. This high pressure fluid is injected out of annular fluid ports located between the O-rings 7*a*, 7*b* and 84*a*, 84*b* in their respective roller cages 39 and 114. This high pressure fluid causes each of the O-rings 7*a*, 7*b* and 84*a*, 84*b* to roll away from its respective roller cage 39 and up its respective annular ramp until it is tightly wedged between the outer surface of the housing of the sleeving tool 1.1 and the inner surface of the sleeve. Consequently, the hydraulic pressure within the longitudinal portions of the sleeve 30 across these O-rings 7*a*, 7*b* and 84*a*, 84*b* intensifies until the walls of the sleeve 30 being to bulge toward the inner walls of the heat exchange tube 31 within which the sleeve is concentrically disposed.

While this hydraulic expansion is occurring, microcomputer 267 has actuated the hydraulic motor 240 to drive the tapered drive mandrels 46 and 120 so that the rolls 37*a*, 37*b* and 37*c* of the upper roller 35 are extended and rollingly engaged against the inner walls of the sleeve 30. It should be noted at this juncture that, while the hydraulic motor 240 rotates in a clockwise direction the coupling shaft 65, only the upper rolls 37*a*, 37*b* and 37*c* of the upper roller assembly 35 will be forcefully driven against the sleeve 30; the rolls 112*a*, 112*b*, 112*c* in the left-handed roller cage 114 will only rotate idly as long as the central drive shaft 65 is driven in a clockwise direction by the motor 240.

Figure 3:
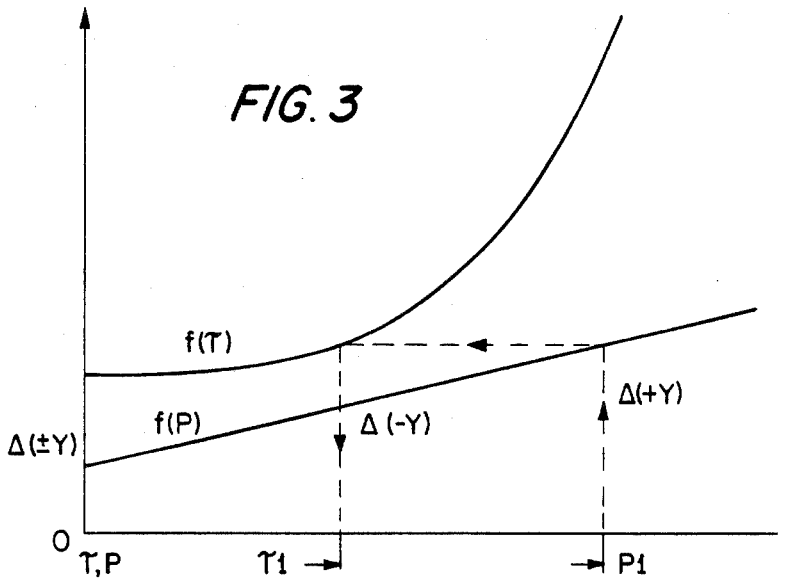
FIG. 3 is a graph illustrating the parameters pertinent in choosing pressure and torque values which will result in a substantially stress-free interference-type joint.

The peak value chosen for the torque applied to the rolls in the upper roller assembly 35 is dependent upon the peak value chosen for the fluid pressure generated by the hydraulic expansion unit 262. When a substantially stress-free joint is desired, these torque and pressure values will be chosen in accordance with the graph in FIG. 3. In this graph, the line designated F(P) demonstrates the amount of contraction $\Delta(-y)$ which the sleeve 30 experiences in the longitudinal portion 34 across the upper roller and expander assembly 4 as a result of hydraulic pressure. As is evident from the graph, the amount of contraction $\Delta(-y)$ that the sleeve 30 experiences is directly proportional to the peak value of the hydraulic pressure applied to it by the hydraulic expansion unit 262.

Let us assume that the operator of the apparatus chooses a peak pressure of "P1". The line graph of FIG. 3 tells the operator that the sleeve 30 will contract a longitudinal distance of $\Delta(-y)$ (showin by the dotted line) in response to the radially directed hydraulic force applied thereon. The graph in FIG. 3 also includes an exponential curve designated $F(\tau)$ located above the previously discussed line function which illustrates the amount of elongation the sleeve will experience in the longitudinal portion across the upper roller and expander assembly 4 as a function of the torque applied onto the central drive shaft 65 to the upper roller 35. States more simply, $\Delta(+y)=F(\tau)$.

In order to create a substantially stress-free interference-type joint between the sleeve 30 and its surrounding tube 31, the operator chooses a peak which will elongate the sleeve 30 the exact distance that the hydraulic expansion will contract it. Accordingly, the operator projects a horizontal line backwards from the intercept point "P1" on the line function F(P) and locates the point on the curve "$\tau$1" which corresponds to an elongation of the sleeve $\Delta(+y)$, which is exactly equal to the contraction of the sleeve $\Delta(-y)$ caused by the hydraulic expansion. By choosing torques $\tau$ on the curve $F(\tau)$ in this manner, the operator creates a substantially stress-free interference-type joint between the sleeve 30 and its surrounding tube 31, in which the contraction of the sleeve caused by the hydraulic expansion is exactly cancelled out by the elongation of the sleeve caused by the rolling engagement of the upper roller 35. As will be described in more detail hereinafter, once these peak pressure and torque values are entered into the memory of the microcomputer 267, the microcomputer 267 implements the sleeving process through the tool 1.1 by sensing and controlling the torques applied on the roller assembles 35 and 110 by the hydraulic motor 240.

Specific Description of the Apparatus of the Invention

Figure 4A:
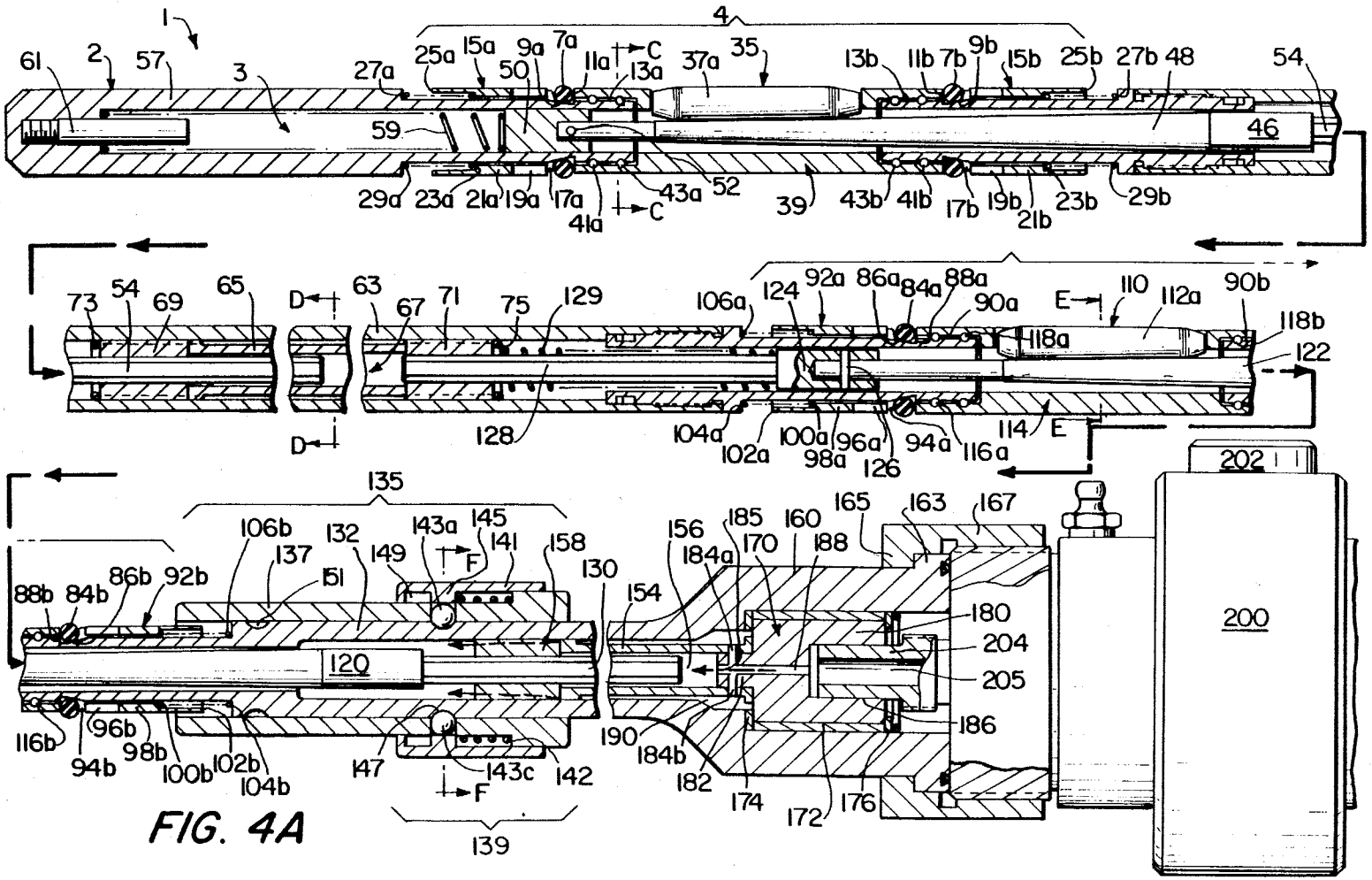
FIG. 4A is a side, cross-sectional view of the sleeving tool of the apparatus of the invention.

With reference now to FIGS. 4A and 4B, the sleeving tool 1.1 used in the overall apparatus 1 of the invention includes an elongated, cylindrical housing having an upper portion 2, a central portion 63, a lower portion 132, and an elongated end 160. All portions of the housing of the tool 1.1 include a centrally disposed bore 3 for conducting pressurized hydraulic fluid to both the upper and lower roller and expander assemblies 4 and 80. At the outset, it should be noted that there is sufficient radial clearance between the centrally disposed bore 3, the tapered bodies 48 and 122 of the upper and lower drive mandrels 46 and 120, and the associated central drive shaft 65 to allow pressurized hydraulic fluid entering the enlarged end 160 of the housing to flow essentially unimpeded up to the hydraulic expanders in the upper and lower roller and expander assemblies 4 and 80. Additionally, unless otherwise specified, all parts of the sleeving tool 1.1 are made from 300M tool steel due to its high strength and resistance to corrosion and degradation from the wet and often radioactive environments where the tool 1.1 performs its work. Preferably, all male threads in the tool 1.1 are nickel-plated to prevent galling between the tool steel surfaces in the various parts of the tool 1.1.

The upper roller and expander assembly 4 generally comprises an upper roller 35 which is flanked on either side by the previously discussed O-ring assemblies 5*a*, 5*b* which form the hydraulic expander of the assembly 4. O-ring assemblies 5*a*, 5*b* each include O-rings 7*a*, 7*b* which are rollingly movable in opposite directions along the longitudinal axis of the upper portion 2 of the cylindrical housing of the tool 1.1 whenever pressurized fluid from the hydraulic expansion unit 262 is injected through the annular ports 13*a*, 13*b* from the centrally disposed bore 3. In FIG. 4A, the O-rings 7*a*, 7*b* are shown in their "rest" positions at the bottom of annular ramps 9*a* and 9*b* and against the annular shoulders 11*a*, 11*b* presented by the upper and lower edges, respectively, of the right-handed roller cage 39. When pressurized fluid flows from the annular ports 13*a*, 13*b*, the O-rings 7*a*, 7*b* are hydraulically rolled up their respective annular ramps 9*a*, 9*b* and against the equalizer rings 17*a*, 17*b* of their respective spring-biased retaining ring assemblies 15*a*, 15*b*.

As each of the O-rings 7*a*, 7*b* rolls up its respective annular ramp 9*a*, 9*b* and pushes back its respective retaining ring assembly 15*a*, 15*b*, it becomes firmly seated between the outside surface of the upper portion 2 of the housing of the sleeving tool 1.1, and the inner surface of the sleeve 30. Such a firm seating engagement is necessary in view of the fact that hydraulic pressures of as much as 14,000 psi may be necessary to expand the longitudinal portion of the sleeve 30 between the O-rings 7*a*, 7*b* when the tool is used to sleeve nickel-based superalloy tubes in nuclear steam generators.

The outer edges of O-rings 7*a*, 7*b* just barely engage the walls of the sleeve 30 when they are seated around the bottom of their respective annular ramps 9*a*, 9*b* and against the shoulders 11*a*, 11*b*. While the natural resilience of the O-rings 7*a*, 7*b* biases them into such a minimally engaging position in their annular recesses 9*a*, 9*b* when no pressurized fluid is being discharged out of the annular orifices 13*a*, 13*b*, each of the O-ring assemblies 5*a*, 5*b* includes a retaining ring assembly 15*a*, 15*b* which is biased toward the annular fluid ports 13*a*, 13*b* via springs 27*a*, 27*b*. The springs 27*a*, 27*b* are powerful enough so that any frictional engagement between the interior walls of the sleeve 30 and the outer edges of the O-rings 7*a*, 7*b* which occurs during the positioning of the tool 1.1 within the sleeve 30 will not cause either of the O-rings to roll up their respective ramps 9*a*, 9*b* and bind the tool 1.1 against the walls of the sleeve 30. Such binding would, of course, obstruct the insertion or removal of the tool 1.1 from the sleeve 30, in addition to causing undue wear on the O-rings 7*a*, 7*b* themselves. If conventional O-rings are used in the tool 1.1, it may be necessary to apply glycerin to the inside walls of the sleeve 30 and over the outside surfaces of these rings prior to each insertion as a final safeguard against binding. However, the application of glycerin may be entirely obviated if Model No. 204-976 "Go-Ring" type O-rings are used. Such rings are available from Greene, Tweed and Company, located in North Wales, Penna.

Each of the spring-biased retaining ring assemblies 15*a*, 15*b* is actually formed from a urethane ring 19*a*, 19*b* frictionally engaged to a stainless steel equalizer ring 17*a*, 17*b* on the side facing the O-rings 7*a*, 7*b*, and a stainless steel spring retaining ring 21*a*, 21*b* on the side oposite the O-rings 7*a*, 7*b*. The urethane rings 19*a*, 19*b* are resilient under high pressure, and actually deform along the longitudinal axis of the tool 1.1 during a hydraulic expansion operation. Such deformation complements the functions of the O-rings 7*a*, 7*b* in providing a seal between the outside surface of the housing of the tool 1.1 and the inside surface of sleeve 30. The equalizer rings 17*a*, 17*b* insure that the deformation of the urethane rings 19*a*, 19*b* occurs uniformly around the circumference of these rings. The sliding motion of each of the retaining ring assemblies 15*a*, 15*b* along the longitudinal axis of the tool 1.1 is arrested when the upper edges 25*a*, 25*b* of the spring retainer rings 21*a*, 21*b* engage upper and lower annular shoulders 27*a*, 27*b* present in the upper portion 3 of the housing of the tool 1.1.

The upper roller and expander assembly 4 includes a roller 35 for applying a rolling mechanical pressure on the inside walls of the sleeve 30 while the previously mentioned O-ring assemblies 5*a*, 5*b* apply a hydraulic expanding force into the sleeve 30. The upper roller assembly 35 is formed from at least three tapered rolls 37*a*, 37*b*, 37*c* mounted within a right-handed roller cage 39. The "handedness" of a roller cage refers to the direction that the rollers in the cage are inclined relative to the longitudinal axis of the cage. In the case of right-handed roller cage 39, the rolls 37*a*, 37*b* and 37*c* have a very slight, left-handed screw "pitch" thereon (shown in exaggerated form in FIG. 1). While the roller cage 39 is freely rotatable relative to the upper portion 2 of the housing of the sleeving tool 1.1, it is prevented from longitudinal movement by outer and inner dowel pins 41*a*, 41.1*a*, 41*b*, 41.4*b* and 43*a*, 43.1*a*, 43*b*, 43.1*b*. The structural arrangement between the dowel pins 43*a*, 43*b* and the roller cage 39 is best illustrated in FIG. 4C, which represents a section of the tool 1.1 cut along line C-C in FIG. 4A. FIG. 4C illustrates the two parallel bores 44 and 44.1 into which the two inner dowel pins 43*a*, 43.1*a* are inserted. The dowel pins 43*a*, 43.1*a* would tend to lock the roller cage 39 against rotational movement relative to the sleeve-like upper housing 2 were it not for the provision of an annular groove 45 circumscribing the outside surface of the upper housing 2 which registers with the bores 44 and 44.1. Annular groove 45 allows the inner dowel pins 43*a*, 43.1*a* to effectively resist any relative longitudinal motion between the upper housing 2 and the roller cage 39 without impeding rotational movement between these two parts. Corresponding annular grooves (not shown) exist for each of the other pairs of dowel pins.

FIG. 4G illustrates an alternative embodiment to the dowel pin and groove arrangement for rotatably mounting the roller cage 39 onto the upper housing 2.

Here, eight radially-oriented pins 43*a*, 43.1*a*, 43.2*a*, 43.3*a*, 43.4*a*, 43.5*a*, 43.6*a* and 43.7*a* are used in lieu of the tangentially oriented pins 43*a* and 43.1*a* illustrated in FIG. 4C. Each of these radially oriented pins is maintained in place by means of a very short retention screw 47*a*, 47.1*a*, 47.2*a*, 47.3*a*, 47.4*a*, 47.5*a*, 47.6*a* and 47.7*a* sunk just below the outside surface of the cage 39. Such a radial pin configuration affords a great deal of shear strength to the mouting between the roller cage 39 and the upper housing 2, which is desirable in view of the fact that this mounting may have to endure over 3,000 lbs. of shear or thrust force when the tool 1.1 is used to sleeve tubes in nuclear steam generators.

The upper roller assembly 35 further includes a tapered drive mandrel 46 for rotatively driving the rollers 37*a*, 37*b* and 37*c* in roller cage 39 against the inside walls of the sleeve 30. Tapered mandrel 46 includes a tapered body 48 in its central portion, a piston 50 in its upper portion which is freely slidable within central bore 3 of the upper housing 2 of the tool 1.1, and a spindle 54 having a polygonal cross-section which is freely slidable within upper spindle receiver 69 of the central drive shaft 65. To persons skilled in the machine tool art, tapered mandrel 46 is a "floating" drive mandrel due to its ability to extend or contract along the longitudinal axis of the tool 1.1 while driving its respective rolls. The piston 50 is preferably held in place on the upper portion of the tapered body 48 of the mandrel 46 by means of dowel pin 52. The upper portion 2 of the housing of the tool 1.1 includes a coil spring 59 for biasing the tapered mandrel 46 into the roller disengaging position illustrated in FIG. 4A. The topmost section of upper housing 2 includes an end cap 57 which houses a stroke-limiting screw 61. Screw 61 limits the longitudinal extent to which the tapered mandrel 48 can move upwardly within the housing of the tool. As is evident both in FIGS. 4A and 4B, the further the tapered mandrel extends up through central bore 3 of the upper housing tool 2, the more the tapered body 48 of the mandrel 46 will radially extend the rollers 37*a*, 37*b* and 37*c*. Although in the preferred embodiment the amount of radial pressure (and hence radial expansion which the rolls 37*a*, 37*b* and 37*c* exert on the sleeve 30 is controlled by the microcomputer 267 working in connection with torque sensor 208, it should be noted that this radial pressure can also be controlled by the stroke-length adjustment screw 61.

The structure of the lower roller and expander assembly 80 is, in almost all respects, exactly the same as that of the upper roller and expander assembly 4. The only differences are that (1) the roller cage 114 of the roller assembly 110 is left-handed, rather than right-handed, and (2) the tapered, floating mandrel 120 in the assembly 80 includes a top spindle 128 with a polygonal cross-section in addition to a lower piston acting spindle 130. In all other respects, however, the structures between the assemblies 4 and 80 are the same. Specifically, the lower roller and expander assembly includes an expander generally comprised of a pair of O-ring assemblies 82*a*, 82*b* which are identical in structure to the upper expander O-ring assemblies 5*a*, 5*b*. These O-ring assemblies 82*a*, 82*b* include a pair of O-rings 84*a*, 84*b*, each of which circumscribes an annular ramp 86*a*, 86*b* and engages a retaining shoulder 88*a*, 88*b* when no pressurized hydraulic fluid flows from ports 90*a*, 90*b*. The retaining ring assemblies 92*a*, 92*b* each include equalizer rings 94*a*, 94*b*, urethane rings 96*a*, 96*b* and spring retainer rings 98*a*, 98*b* which correspond exactly to the equalizer rings 17*a*, 17*b*, urethane rings 19*a*, 19*b* and spring retainer rings 21*a*, 21*b* of the upper roller and expander assembly 4. Additionally, the retaining ring assemblies 92*a*, 92*b* are spring-loaded by way of retaining springs 106A*a*, 106*b*, and the entire hydraulic expander mechanism of assembly 80 works in exactly the same way as the hydraulic expander mechanism of assembly 4. Finally, the rolls 112*a*, 112*b* and 112*c*, roller cage 114, inner and outer dowel pins 116*a*, 116.1*a*, 116*b*, 116.1*b*, 118*a*, 118.1*a*, 118*b*, 118.1*b* and lower tapered mandrel 120 of the lower roller 110 are structurally and functionally equivalent in all respects to the rolls 37*a*, 37*b* and 37*c*, roller cage 39, outer and inner dowel pins 41*a*, 41.1*a*, 41*b*, 41.1*b*, 43*a*, 43.1*a*, 43*b*, 43.1*b*, and upper tapered mandrel 46 of the upper roller assembly 35, the only exception being that lower roller cage is left-handed as previously pointed out, while upper roller cage is right-handed. While FIG. 4E shows a cross-sectional view of the lower roller cage 122, the upper roller cage 37 would look exactly the same through a corresponding section.

FIG. 4B is the clearest view of the drive shaft assembly which drives both the upper and lower roller assemblies 35 and 110. This drive shaft assembly includes the previously mentioned upper and lower tapered, floating mandrels 46 and 120. Upper mandrel 46 includes a polygonal spindle 54 which is slidably engaged within a spindle receiver 69 in the central drive shaft 65. Similarly, lower drive mandrel 120 includes an upper polygonal spindle 128 which is slidably receivable in the lower spindle receiver 71 of the central drive shaft 65. The lower drive mandrel 120 further includes the previously mentioned drive spindle 130 extending from its lower portion. Like spindles 54 and 128, the cross-section of drive spindle 130 is polygonal. Spindle 130 is receivably slidable into a polygonal bore located in spindle receiver 158 of lower coupling shaft 154. The lower coupling shaft 154 is in turn rigidly mounted onto the cylindrical bearing body 180 of the radial bearing assembly 170. The polygonal cross-sections of the spindles 54, 128 and 130 allow them to accomplish their two-fold function of effectively transmitting torque from the hydraulic motor 240 to the rollers 37*a*, 37*b*, 37*c* and 112*a*, 112*b*, 112*c* of the roller assemblies 35 and 110, while simultaneously allowing the mandrels 46 and 120 to freely slide within the spindle receivers 69, 71 and 158 of the central and lower drive shafts, respectively, without locking. In the preferred embodiment, drive spindles 54, 128 and 130 are Model PC-4 polygon-type drive spindles manufactured by the General Machinery Company of Millville, N.J.

This sliding or "floating" property of the upper and lower mandrels 46 and 120 allows them to extend the rolls of their respective roller assemblies 35 and 110 when the drive shaft assembly is rotated in one direction or the other. More specifically, FIG. 4B illustrates the relative positioning of the rolls 37*a*, 37*b*, 37*c* and 112*a*, 112*b*, 112*c* with respect to the upper and lower mandrels 46 and 120 when the drive shaft assembly is rotated in a clockwise direction. Such a clockwise rotation causes the upper rolls 37*a*, 37*b* and 37*c* (which are slightly screw-pitched relative to the longitudinal axis of the tool 1.1) to apply a positive feeding force on the tapered body 48 of the upper mandrel 46 while the rolls rollingly engage the inside of the sleeve 30. Among those skilled in the art, this particular type of roller is commonly known as a "self-feeding" roller. This positive feeding force in turn pulls the upper mandrel 46 in an upward direction, which causes the tapered body 48 to engage the upper rolls 37*a*, 37*b* and 37*c* with even more pressure. This pressure in turn causes an even stronger feeding force to pull up on the mandrel 46, thereby extending the rolls even further, and drawing the mandrel all the way up into the position illustrated. However, in stark contrast to the positive coaction between the upper mandrel 46 and the upper rollers 37*a*, 37*b* and 37*c*, any feeding force that the left-handed rolls 112*a*, 112*b* and 112*c* apply on their respective drive mandrel 120 only tends to pull the tapered body 122 of the mandrel 120 down into the "idling" position illustrated in FIG. 4B. Such a "negative" or non-feeding force results from the fact that the slight screw-pitch of the left-handed rolls is opposite in orientation to the screw pitch of the right-handed rolls.

Of course, the coaction between the rolls and their respective mandrels is reversed when the drive shaft assembly is turned in a counterclockwise direction. In such a case, the tapered body 48 of the upper mandrel 46 will disengage from its respective rolls 37*a*, 37*b* and 37*c* into an idling position, while the lower rolls 112*a*, 112*b* and 112*c* apply a positive feeding force onto the tapered body 122 of their associated mandrel 120. As the lower mandrel 120 slides up, the rolls 112*a*, 112*b* and 112*c* apply progressively more rolling pressure onto the inside of the lower portion of the sleeve 30, which causes them to apply a progresively greater feeding force on the lower mandrel 120. As independently floating mandrels which operate in conjunction with rollers of opposite screw pitch is highly advantageous, in that it allows a different amount of torque (and hence a different degree of rolling pressure) to be applied between the upper and lower interference-type joints which the tool 1.1 creates between sleeve 30 and tube 32. Additionally, this arrangement has the added benefit of preventing the central drive shaft 65 from experiencing the "double-load" of torque that would otherwise be applied if both the roller cages were of identical handedness, which would necessitate rolling both the upper and lower interference joints 34 and 34.1 at the same time.

With reference back to FIG. 4A, the lower portion 132 of the tool housing generally includes a tool thrust collar assembly 135, while the enlarged lower end 160 of the tool housing encloses the previously-mentioned radial bearing assembly 170.

The principal function of the thrust collar assembly 135 is to maintain the tool 1.1 in a proper position with respect to the sleeve and tube 31 during the rolling process, which applies large longitudinal forces to the tool 1.1 as a result of the screw-pitched rolls 37*a*, 37*b* and 37*c* screw-feeding into the sleeve 30. The tool thrust collar assembly 135 generally includes a retainer collar 137 which is longitudinally movable along the tool housing by means of the sliding collar 139. Sliding collar 139 includes a spring-loaded retainer collar 141 for maintaining detent balls 143*a*, 143*b*, 143*c* and 143*d* in either an upper annular groove 151 or a lower annular groove 147, both of which circumscribe the lower tool housing 132. In FIGS. 4A and 4F, these detent balls are shown seated in the lower annular groove 147. However, the entire thrust collar assembly 135 may be slid upwardly so that the detent balls 143*a*, 143*b*, 143*c* and 143*d* seat in upper annular groove 151. This may be accomplished by simply pulling backwards on the retainer collar 141 so that the annular recess 149 replaces the bearing ring 145 (which is preferably integrally formed with the collar 141) which normally engages the tops of the balls. In this position, the thrust collar assembly 135 may be moved upwardly until the balls reseat themselves into the upper annular groove 151. Once such seating is accomplished, the retainer collar 141 is released. The spring 142 of the retainer collar will then reposition the bearing ring 145 over the detent balls, thereby securing them into the upper annular groove 151 in the lower tool housing 132. Such an action will, of course, have the effect of pushing the tool 1.1 into a lower position relative to the sleeve 30, which is useful when the operator of the tool 1.1 wishes to roll the sleeve 30 hear its lowest end.

The enlarged lower end 160 of the tool housing includes an annular flange 163 which overlaps with an annular lip 165 of hexagonal nut 167. As previously mentioned, the enlarged end 160 of the tool housing contains the radial-bearing assembly 170. Bearing assembly 170 generally includes a cylindrical bronze shell 172, front and rear thrust-bearing bronze disks 174, 176, retaining ring 178, and the previously mentioned cylindrical bearing body 180 which is engaged to the lower drive shaft 154. The cylindrical bearing body 180 includes a stub shaft 182 which is concentrically disposed within the lower drive shaft 154 in the position indicated. Stub shaft 182 includes a pair of lateral fluid ports 184*a*, 184*b* which branch off from a central fluid port 185. At its rear portion, the cylindrical bearing body 180 includes a hexagonal recess 186 for receiving a complementary hexagonal output shaft 204 of high pressure swivel joint 200. Output shaft 204 includes a centrally disposed fluid port 205 which fluidly connects with central fluid port 185 of the cylindrical bearing body 180. Surrounding the lateral fluid ports 184*a*, 184*b* is a fluid-conducting annulus 190 which communicates with the outer portion of the centrally disposed bore 3. Additionally, the central fluid port 185 communicates with the central portion of this centrally disposed bore 3 via the hollow interior 156 of the rear drive shaft 154. The provision of the two lateral ports 184*a*, 184*b* insures that high pressure fluid conducted through swivel joint 200 from the hydraulic expansion unit 262 will readily flow into the O-ring assemblies 5*a*, 5*b* and 82*a*, 82*b* as well as to the piston 50 of the upper mandrel 46; the provision of central fluid port 185 insures that at least some of this high pressure fluid will push the mandrel 120 into contact with its respective rolls.

Figure 5A:
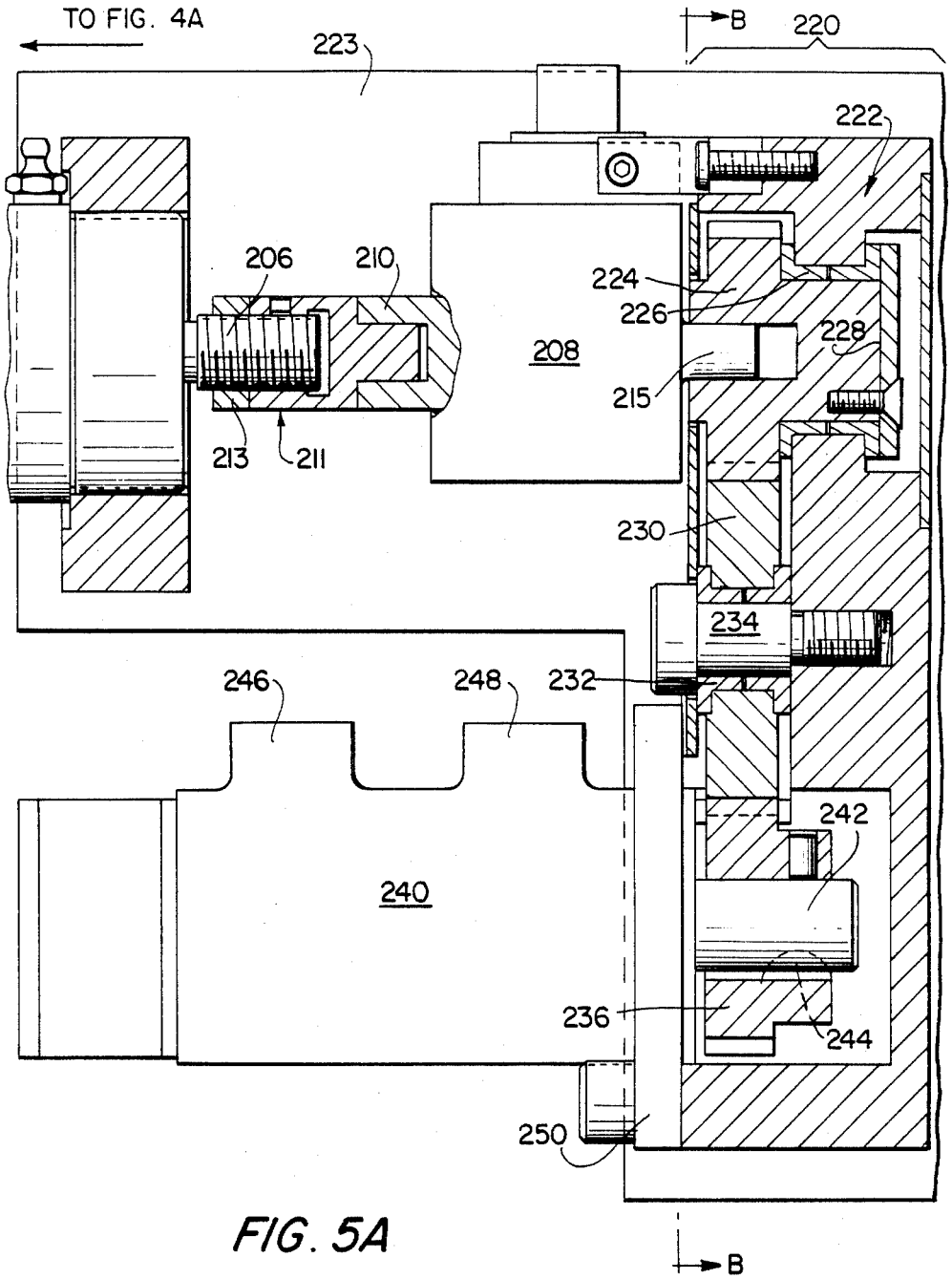
FIG. 5A is a side, partial cross-sectional view of the transmission assembly, swivel joint, and hydraulic motor of the sleeving tool used in the apparatus of the invention.

With reference now to FIG. 5A, high pressure swivel joint 200 mechanically couples the output shaft 210 of the torque sensor 208 to the radial-bearing assembly 170 via hexagonal output shaft 204. Additionally, swivel joint 200 hydraulically couples the centrally disposed bore 3 of the tool 1.1 with the hydraulic expansion unit 262. To this end, swivel joint 200 includes a quick-disconnect hydraulic fluid coupling 202 which may be fitted into a complementary coupling (not shown) on the end of the high pressure hose 264 of the hydraulic expansion unit 262. Swivel joint 200 may be a Model No. A-45 joint manufactured by Hydro-Ergon of Chicago, Ill., modified to include a lateral coupling instead of a rear coupling. The input shaft 206 of the swivel joint 200 is coupled to the output shaft 210 of the torque sensor 208 by means of output coupling 211. The output shaft 211 includes jam nut 213 which threadedly engages with the threaded end of the input shaft 206 of the swivel joint 200.

In the preferred embodiment, the torque sensor is a Model No. RN500PI torque transducer manufactured by United Bolting Technology of Metuchen, N.J. The torque sensor 208 further includes a square input shaft 215 which fits into a complementary recess in the driven gear 224 of the transmission assembly 220. The torque sensor 208 is electrically connected to the microcomputer 267 via a plurality of appropriate cables and leads schematically represented in FIG. 1 as cable 269. Thus, the torque sensor 208 allows the microcomputer 267 to continuously monitor the amount of torque which the hydraulic motor 240 applies to the drive shaft assembly of the tool 1.1 through transmission assembly 220.

Figure 5B:
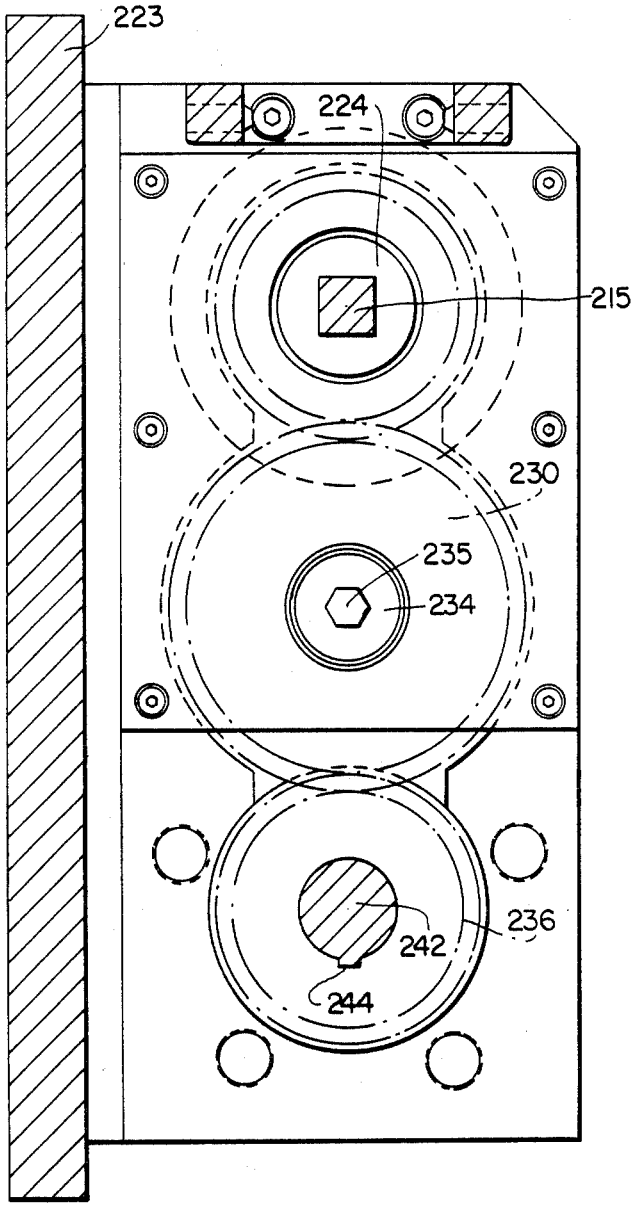
FIG. 5B is a bottom, cross-sectional view of the transmission assembly illustrated in FIG. 5A, taken along line B—B.

With reference now to FIGS. 5A and 5B, transmission assembly 220 includes a gear housing 222 which is mechanically connected to the rest of the sleeving tool 1.1 by means of mounting plate 223. The overall purpose of transmission assembly 220 is to render the tool 1.1 more compact along its longitudinal axis and therefore easier to handle by either a human operator, or more preferably, a robotic arm. The structure of the transmission assembly 220 includes three gears, namely an output or driven gear 224, an idler gear 230, and a driven gear 236 which is directly engaged to the output shaft 242 of hydraulic motor 240. As previously mentioned, the driven gear 224 includes a square recess for receiving the square input shaft of the torque sensor 208. Moreover, the driven gear 224 is circumscribed by a bearing 226 held in place by a bearing retainer 228 as indicated in the drawings. The gear teeth of the driven gear 224 intermesh with the teeth of the idler gear 230. Idler gear 230 includes a centrally disposed bearing 232 held in place by bearing bolt 234. On its bottom side, the teeth of the idler gear 230 intermesh with the teeth of the driven gear 236. Drive gear 236 is engaged to the output shaft 242 of hydraulic motor 240 via a key arrangement of conventional structure. A mounting plate 250 holds the hydraulic motor 240 onto the housing of the gear assembly 220. It should be noted that the transmission assembly 220 transfers rotary power from the hydraulic motor to the input shaft 206 of the swivel joint 200 in a one-to-one gear ratio.

In the preferred embodiment, hydraulic motor 240 is a Model No. A-37F motor manufactured by Lamina, Inc., of Royal Oak, Mich. Hydraulic motor 240 includes an inlet port 246 and an outlet port 248 which are fluidly connected to the hydraulic power supply 255 via conventional, quick-disconnect couplings.

The balance of the components of the apparatus 1 are conventional, commercially available items. For example, the hydraulic power supply 255 used in the invention 1 is preferably a Model No. PVB10 power supply manufactured by Airtek Inc. of Irwin, Penna. Likewise, the directional control valve 257 is preferably a Model No. A076-103A type, bidirectional valve manufactured by Moog, Inc. of East Aurora, N.Y. The hydraulic expansion unit 262 may be a "Hydroswage"-brand hydraulic expansion unit manufactured by the Haskel Corporation of Burbank, Calif., modified to include a pressure transducer so that it can be set to maintain a desired pressure. The pressure transducer coupled to the Haskel-brand unit may be a Model No. AEC-20000-01-B10 pressure transducer and display assembly manufactured by Autoclave Engineers, Inc. of Erie, Penna. The microcomputer 267 is preferably an Intel 88-40 microcomputer which includes a clock chip. Such computers are manufactured by the Intel Corporation of Santa Clara, Calif. The television monitor 273 and keyboard 275 are preferably part of the Intel 88-86 microcomputer, and the torque analyzer 280 is preferably a Model No. ETS-DR manufactured by Torque and Tension Equipment of Campbell, Calif.

As indicated in FIG. 1, the output of the hydraulic expansion unit 262 is fluidly connected to the fluid inlet 202 of the high-pressure swivel joint 200 via high pressure hose 264. Additionally, the hydraulic motor 240 is connected to the hydraulic power supply 255 via directional control valve 257 and hydraulic hoses **259*a*, 259*b*. Directional control valve 257 controls the direction that the drive shaft within the housing of the tool 1.1 rotates, since it can reverse the direction of flow of fluid through the hydraulic hoses 259*a*, 259*b* leading into hydraulic motor 240. As previously indicated, the input of the microcomputer 267 is connected to the torque sensor 208 through cable 269, which allows the microcomputer 267 to continuously monitor the amount of torque which the hydraulic motor 240 exerts on the drive shaft 65 within the sleeving tool 1.1. Finally, the output of the microcomputer 267 is connected to the directional control valve 257 via cable 271*a*, the hydraulic power supply 255 via cable 271*b*, and the hydraulic expansion unit 262 via cable 271*c*, as indicated. Although not shown in detail, the electrical signals transmitted from the microcomputer 267 through the cables 271*a*, 271*b* and 271*c* are augmented by conventional amplifiers and solid-state relays, and are capable of changing the direction of fluid flow through the directional control valve 257, and the on-off state of the hydraulic power supply 255 and the hydraulic expansion unit 262**.

Specific Description of the Process of the Invention

In the preliminary steps of the process of the invention (which are not indicated in the flow chart of FIG. 6), a suitable reinforcing sleeve is first slid over the housing of the tool 1.1. The tool 1.1 is then inserted into the open end of the tube to be sleeved. The precise metallurgical properties and dimensions of the sleeve used in the process will depend upon the dimensions and metallurgical properties of the tube being sleeved. However, if the sleeving tool 1.1 is used to sleeve an Inconel tube in the vicinity of a tube sheet in a nuclear steam generator, the sleeve used will be formed from Inconel alloy, and have an outer diameter of 0.740 in. and a wall thickness of 0.040 in. If necessary, the inside of the sleeve may be swabbed with a thin coat of glycerin so as to prevent unwanted binding between the O-rings in the O-ring assemblies 4 and 80 while the sleeve is slid around the body of the tool 1.1. With specific reference to FIG. 4A, the sleeve is slid completely down the housing of the sleeving tool 1.1 until its bottommost ege abuts the upper edge of the thrust collar assembly 135. Thus positioned, the tool 1.1 and sleeve are then inserted into the open end of the tube to be sleeved until the bottom edge of the tube abuts the upper edge of the retainer collar 137 of the tool thrust collar assembly 135.

Figure 6:
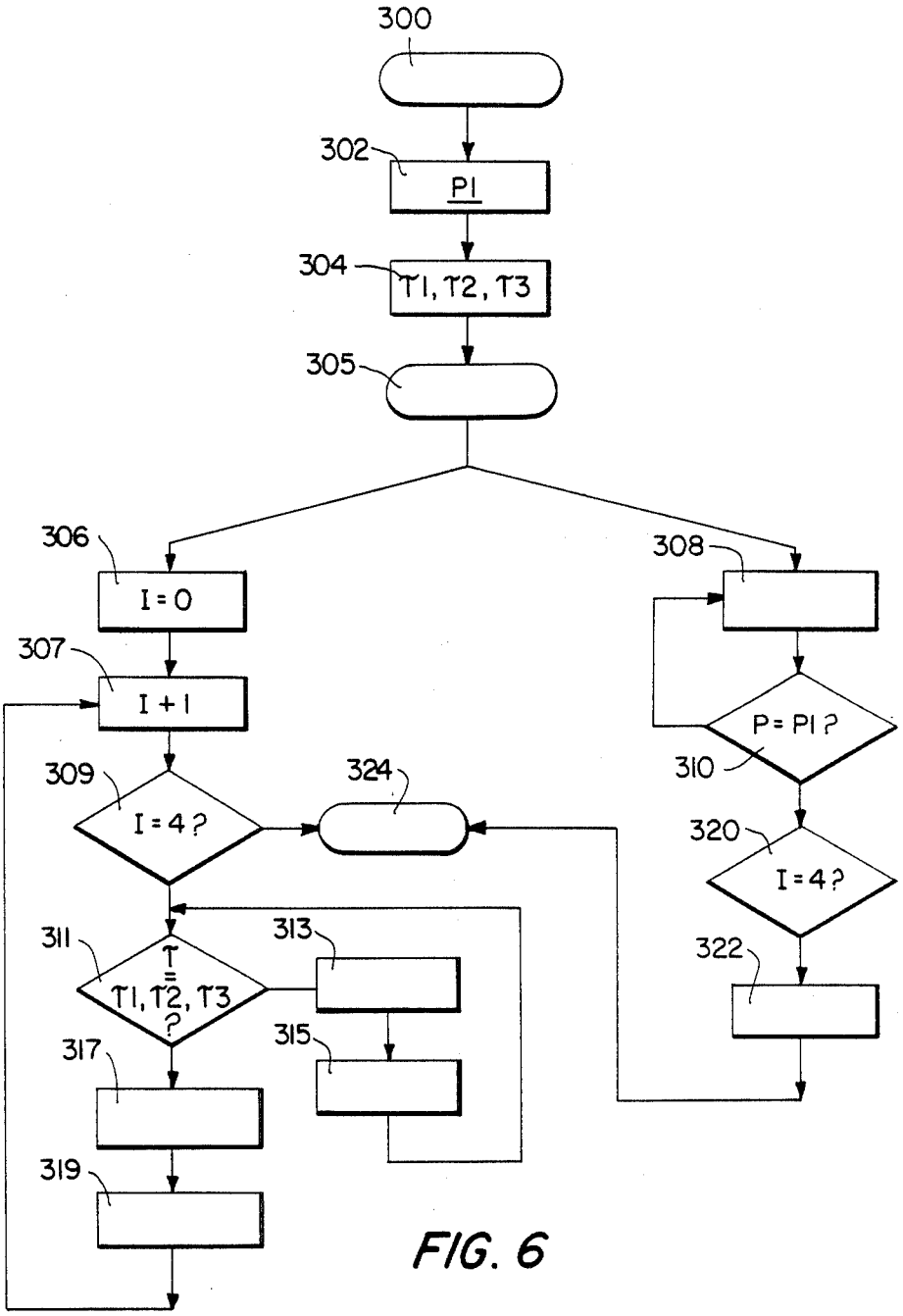
FIG. 6 is a flow chart illustrating the process of the invention.

With specific reference now to block 300 of FIG. 6, the microcomputer 267 is started after the aforementioned preliminary steps have been executed. Next, as indicated in process block 302, the desired peak pressure P1 for the hydraulic expansion unit 262 is chosen and entered into the memory of the microcomputer 267. Immediately thereafter, as indicated in process block 304, peak torque values $\tau 1$ and $\tau 2$ are chosen for the upper and lower interference joints in accordance with the pressure-torque relationship illustrated in FIG. 3, and entered into the memory of the microcomputer 267. This step may be carried out either manually or by the microcomputer 267. If the lower section of the tube is surrounded by a tubesheet, the operator will normally want to select a somewhat higher torque value for the lower interference joint due to the lesser plasticity the tube and sleeve combination will have when surrounded by such a structure. When the sleeveing process is being carried out in an Inconel tube in a nuclear steam generator, typical selected values include hydraulic expansion pressures of between 8,000 and 14,000 psi, and upper and lower torque values of 90 and 120 inch-pounds, respectively. Additionally, a "disengagement" torque $\tau 3$ is also chosen and entered which will effectively disengage the lower rolls 112*a*, 112*b* and 112*c* from the sleeve without re-engaging the upper rolls 37*a*, 37*b* and 37*c* into the sleeve 30. This disengagement torque $\tau 3$ is also entered into the microcomputer 267.

The microcomputer 267 next proceeds to block 305, and simultaneously commences the mechanical rolling operation (boxes 306–319) and the hydraulic expansion cycle (boxes 308–322).

Turning first to the mechanical rolling operation, the microcomputer 267 first clears all the input/output ports in the cycle by setting "I" equal to zero, as indicated. In the mechanical rolling operation, there are four steps (designated "I") in the computer program. These four steps include (1) initialization of the input-/output ports (i.e., setting "I" equal to zero); (2) turning the drive shaft assembly of the tool 1.1 in a clockwise direction until the peak torque value $\tau 1$ is attained; (3) turning the drive shaft assembly of the tool 1.1 in a counterclockwise direction until the selected peak torque $\tau 2$ is attained, and (4) turning the drive shaft assembly again in a clockwise direction (in order to disengage the lower roller from the inside of the sleeve) until the selected peak torque $\tau 3$ is attained.

After initializing its input/output ports, microcomputer 267 proceeds to block 307 and adds "1" to the variable "I", thereby advancing the operation one step.

Immediately upon adding "1" to "I", the microcomputer 267 asks itself whether or not "I" equals 4 (i.e., whether or not it is on the final step of the mechanical rolling operation). If it answers this question in the negative, it proceeds to "stop" block 324, and terminates the rolling operation. However, if it answers this question in the affirmative, it proceeds to the next step of the program, question block 311.

At question block 311, the microcomputer inquires whether or not the peak torque for the corresponding program step has been attained. For the first step in the operation (i.e., $I=1$), it will specifically ask whether or not the torque sensor 208 senses the torque of $\tau 1$. If not, it proceeds to block 313 of the program, and converts the analog signal it is constantly receiving from the torque sensor 208 and converts it into a digital value. After such conversion has been completed, it proceeds to block 315 in the program, and scales the resulting digital value for the particular transducer used for torque sensor 208. At the end of block 315, it feeds this value back into question block 311.

During this time, the microcomputer 267 has actuated the hydraulic power supply, and set the state of the bidirectional valve 257 so that the hydraulic motor 240 rotates the drive shaft assembly of the tool 1.1 in a clockwise direction. As time passes, the drive shaft in the tool 1.1 is driven with progressively more torque in a clockwise direction by hydraulic motor 240 and hydraulic power supply 255. As the upper mandrel 46 drives the upper rolls 37*a*, 37*b* and 37*c* with progressively more torque, the microcomputer 237 ultimately answers the question in question block 311 in the affirmative. When this occurs, the microcomputer proceeds to block 317, and stops the drive shaft assembly in the tool 1.1 for one second by deactuating the hydraulic power supply 255 for one second. The microcomputer then proceeds to block 319 and changes the state of bidirectional valve 257. Immediately thereafter, it loops back around to block 307, and adds "1" to "I" as indicated. This brings it to the second step in the mechanical rolling operation, whereupon the microcomputer reactuates the hydraulic power supply 255. Because the state of the bidirectional valve 257 has been reversed, the hydraulic power supply 255 drives the drive shaft assembly in the tool 1.1 in a counterclockwise direction. The counterclockwise motion of the drive shaft disengages the upper rolls 37*a*, 37*b* and 37*c* from the completed upper interference joint, and engages the lower rolls 112*a*, 112*b* and 112*c* against the lower interference joint started by the hydraulic expansion unit 267, until the peak torque value $\tau 2$ is attained. When the microcomputer 267 arrives at the fourth step of the process, and answers question block 309 in the affirmative, it will stop the rolling operation.

While the microcomputer 267 is performing the previously described mechanical rolling operation (steps 306–319), it simultaneously performs the hydraulic expansion steps 308–322. In this simple branch of the overall program, the microcomputer 267 will set the pressure controller which is part of the Haskel Hydroswage® unit 262 so that the hydraulic pressure between the O-ring assemblies 5*a*, 5*b* and 82*a*, 82*b* arrives at the desired pressure P1. It will maintain this pressure until the rolling operation is completed (i.e., when "I" equals 4). In the last step of the hydraulic expansion operation, represented by block 322, it will depressurize the centrally disposed bore 3 of the tool 1.1, and proceed to "stop" block 324.

Interestingly, the applicant has noted that the previously described apparatus and process not only reduces the amount of time needed to produce a substantially stress-free interference joint, but also reduces the total amount of hydraulic and rolling pressures needed to create such joints. Specifically, the applicant has observed that, when the hydraulic expansion and mechanical rolling steps are separately executed, relatively higher pressures and torques are needed to form interference joints of comparable characteristics. Applicant believes this synergistic reduction in the pressure and torques used in his invention results from the fact that the rollers 35 and 110 are able to perform their work while the sleeve walls are in a plastic state from the pressure exerted on them by the hydraulic expansion unit 262. Applicant further believes that the instant invention creates an interference joint which is more corrosion-resistant than joints made from separate hydraulic expanders and rolling tools, since the absolute reduction of the amount of hydraulic pressure and torque used will result in a lesser disruption of the crystalline structure of the metal in the sleeve joints.

What is claimed is:

1. An apparatus for expanding a conduit against a surrounding structure, comprising:

(a) an expander means for hydraulically applying a radially expansive force on the inside of a longitudinal portion of said conduit;

(b) a source of pressurized hydraulic fluid fluidly connected to said expander means for powering the same, and (c) a rolling means having at least one roller and an extendably tapered mandrel for extending and rotating said roller in order to mechanically roll at least a part of said inside longitudinal portion of said conduit at substantially the same time that said expander means applies said radially expansive force on said conduit, wherein said tapered mandrel is fluidly connected to and extended by said source of pressurized hydraulic fluid.

2. The apparatus of claim 1, wherein said conduit is a sleeve and said surrounding structure is a tube.

3. The apparatus of claim 2, wherein said apparatus includes an upper and a lower rolling means for mechanically rolling an upper and a lower portion, respectively, of said sleeve.

4. The apparatus of claim 2, wherein said apparatus includes an upper and a lower expander means for hydraulically applying a radially expansive force on an upper and a lower portion, respectively, of said sleeve.

5. The apparatus of claim 2, wherein said expander means includes a pair of opposing seals for effecting a fluid seal across a longitudinal portion of said sleeve, and a source of pressurized hydraulic fluid for applying pressurized fluid in the region between said sleeve, said tube, and said two opposing seals.

6. The apparatus of claim 5, wherein said rolling means is capable of rolling said sleeve within said longitudinal portion.

7. An apparatus for rapidly joining a sleeve to the inside of a section of tubing in a substantially stress-free joint, comprising:

(a) an expander means for hydraulically applying a radially expansive force on the inside of a longitudinal portion of said sleeve, and (b) a rolling means for mechanically rolling at substantially the same time at least a part of said inside longitudinal portion of said sleeve enough to offset any longitudinal contraction occurring in the hydraulically expanded region of the sleeve, whereby a substantialy stress-free joint is produced between said tube and said sleeve.

8. The apparatus of claim 7, wherein said apparatus includes an upper and a lower rolling means for mechanically rolling an upper and a lower portion, respectively, of said sleeve.

9. The apparatus of claim 7, wherein said apparatus includes an upper and a lower expander means for hydraulically applying a radially expansive force on an upper and a lower portion, respectively, of said sleeve.

10. The apparatus of claim 7, wherein said expander means includes a pair of opposing seals for effecting a fluid seal across a longitudinal portion of said sleeve, and a source of pressurized hydraulic fluid for applying pressurized fluid in the region between said sleeve, said tube, and said two opposing seals.

11. The apparatus of claim 7, wherein said rolling means includes a roller cage with at least one roll.

12. The apparatus of claim 10, wherein said rolling means is capable of rolling said sleeve within said longitudinal portion.

13. The apparatus of claim 11, wherein said rolling means includes a tapered mandrel for both extending and driving said roller.

14. The apparatus of claim 12, wherein said apparatus includes an elongated housing, and wherein said rolling means includes a roller cage with at least one roll which is rotatively mounted in said housing between said seals.

15. The apparatus of claim 14, wherein said rolling means includes a tapered mandrel for both extending and driving said roller.

16. An apparatus for rapidly joining a sleeve to the inside of a section of tubing in a substantially stress-free joint, comprising:

(a) an expander means for hydraulically applying a radially expansive force on the inside of a longitudinal portion of said sleeve, and (b) a rolling means for mechanically rolling at least a part of said inside longitudinal portion of said sleeve while said expander means hydraulically expands said longitudinal portion of said sleeve at substantially the same time, thereby consummating an interference-type joint therebetween, and longitudinally extending said sleeve in said portion enough to substantially offset any longitudinal contraction which occurred as a result of said hydraulic expansion, whereby a substantially stress-free interference-type joint is produced between said sleeve and said tube.

17. The apparatus of claim 16, wherein said apparatus includes an elongated housing.

18. The apparatus of claim 17, wherein said rolling means includes an upper roller cage and a lower roller cage rotatively mounted in tandem on said elongated housing for mechanically rolling an upper portion and a lower portion, respectively, of said sleeve.

19. The apparatus of claim 18, wherein each of said roller cages includes at least one extendable roll.

20. The apparatus of claim 19, wherein said rolling means further includes an upper tapered mandrel and a lower tapered mandrel for extending and driving said roller of said upper and lower roller cages, respectively.

21. The apparatus of claim 20, wherein said expander means includes a source of pressurized hydraulic fluid, and wherein each of said tapered mandrels includes a piston means in fluid communication with said source of pressurized fluid, whereby each of said tapered mandrels extends its respective roller when said expander means exerts a radially expansive force on said sleeve.

22. The apparatus of claim 20, wherein said upper and lower tapered mandrels are slidably coupled onto a common drive shaft.

23. The apparatus of claim 22, wherein said upper roller cage and said lower roller cage include slots of opposite hands, whereby only the roller of said upper roller cage will operatively roll said sleeve when said drive shaft is rotatively driven in one direction, and only the roller of said bottom cage will operatively roll said sleeve when said drive shaft is driven in another direction.

24. The apparatus of claim 23, further including a drive means for rotatively and selectively driving said drive shaft in both a clockwise and coungterclockwise direction.

25. The apparatus of claim 24, further including a torque detector operatively connected between said drive means and said drive shaft for detecting the torque applied onto said drive shaft.

26. The apparatus of claim 25, further including a control means operatively connected both to said torque detector and said drive means for controlling the amount of torque said drive means applies to said drive shaft.

27. An apparatus for rapidly joining a sleeve to the inside of a section of tubing in a substantially stress-free interference-type joint, comprising:

(a) an expander means for hydraulically expanding a longitudinally portion of said sleeve;

(b) a rolling means rotatively driven by a drive means for mechanically rolling at least a part of said longitudinal portion of said sleeve at substantially the same time that said expander means hydraulically expands said longitudinal portion of said sleeve, and (c) a control means operatively connected to said drive means of said rolling means for controlling the maximum amount of torque said drive means applies to said rolling means in order that said rolling means will longitudinally extend said portion of said sleeve by approximately the same amount that said expander means longitudinally contracts said portion of said sleeve.

28. The apparatus of claim 27, wherein said control means includes a torque detector operatively connected to the output of said drive means.

29. The apparatus of claim 27, further including a source of pressurized fluid fluidly connected to said expander means for operating said expander means.

30. The apparatus of claim 29, wherein said rolling means includes at least one roller cage with at least one roll which is radially extendable by means of a mandrel.

31. The apparatus of claim 30, wherein said mandrel includes a portion which is in communication with said source of pressurized fluid.

32. An improved sleeving process of the type wherein a sleeve is first inserted in a tube, and then hydraulically expanded, and next subsequently mechanically rolled to effect an interference-type joint between the tube and the sleeve, wherein the improvement comprises hydraulically expanding and mechanically rolling said sleeve at substantially the same time.

33. An improved sleeving process of the type wherein a sleeve is first inserted in a tube, then hydraulically expanded, and then subsequently mechanically rolled on either end to effect an interference-type joint between the tube and the ends of the sleeve, wherein the improvement comprises hydraulically expanding and mechanically rolling said sleeve at substantially the same time, wherein said sleeve end is mechanically rolled enough to substantially offset any longitudinal contraction occurring in the hydraulically expanded region of the tube, whereby a substantially stress-free joint is produced between said tube and said sleeve.

34. An improved sleeving process of the type wherein a sleeve is first inserted in a tube, then hydraulically expanded along a longitudinal portion, and then subsequently mechanically rolled with a rolling means including a drive shaft to effect an interference-type joint between the tube and the ends of the sleeve, wherein the improvement comprises the steps of mechanically rolling said sleeve along said longitudinal portion by applying a preselected torque onto said drive shaft while simultaneously hydraulically expanding said portion.

35. The improved process of claim 34, wherein said torque is selected so that said rolling extends said longitudinal portion the substantially same distance the hydraulic expansion contracts said portion along its longitudinal axis, whereby a substantially stress-free interference-type joint is formed.

36. An apparatus for rapidly joining a sleeve disposed within a tube to the inside wall of said tube in a stress-free, interference-type joint, comprising:

(a) an expander means for hydraulically applying a hydraulically expansive force on the inside wall of a longitudinal section of said sleeve, wherein said sleeve becomes longitudinally contracted;

(b) a source of pressurized, hydraulic fluid connected to said expander means for powering said expander means;

(c) a rolling means for simultaneously rolling and longitudinally extending said longitudinal section of said sleeve as said expander means radially expands and longitudinally contracts said section, including at least one roller, and an extendable, tapered mandrel for engaging said roller against said longitudinal section of said sleeve, wherein said tapered mandrel includes a piston in fluid communication with said source of pressurized, hydraulic fluid for extending said mandrel and thereby radially extending said roller against said longitudinal section of said sleeve when said hydraulic expander means is actuated;

(d) a motor for rotating said tapered mandrel, and (e) a control means operatively connected to said motor for regulating the maximum amount of torque said motor applies to said tapered mandrel in order to control the amount of rolling pressure said roller applies to said longitudinal section of said tube so that the resulting amount of longitudinal extension that the roller induces in the sleeve is approximately equal to the amount of longitudinal contraction said expander means induces in the sleeve, whereby a substantially stress-free, interference-type joint is created between the tube and the sleeve.

37. An improved sleeving process for rapidly producing a substantially stress-free, interference-type joint between a tube and a reinforcement sleeve disposed within the tube by means of a hybrid hydraulic expansion and mechanical rolling tool having a hydraulic expansion means for hydraulically expanding a selected longitudinal portion of said sleeve, and a mechanical rolling means including at least one roller which is radially extendable by means of a tapered roller for simultaneously applying a rolling pressure to said longitudinal portion of said sleeve while said hydraulic expansion means applies a hydraulic pressure to said portion, comprising the steps of:

(a) inserting said hydraulic expansion means in said selected longitudinal portion of said sleeve;

(b) radially expanding and plastically deforming said longitudinal portion of said sleeve into engagement with said tube by introducing a pressurized fluid into said longitudinal portion having a maximum pressure of P through said hydraulic expansion means;

(c) simultaneously longitudinally extending and plastically deforming said longitudinal portion of said sleeve into engagement with said tube by extending said tapered mandrel and applying a preselected maximum torque T thereon in order to radially extend and rotate said roller, wherein T is chosen so that said portion of said sleeve is longitudinally extended an amount approximately equal to the amount of longitudinal contraction which occurred in said sleeve portion due to said hydraulic expansion;

(d) depressurizing said hydraulic fluid and reversing the direction of rotation of said mandrel while withdrawing said mandrel, and (e) withdrawing said tool from said selected longitudinal portion of said sleeve.

* * * * *